United States Patent [19]

Childs

[11] Patent Number: 4,708,722

[45] Date of Patent: Nov. 24, 1987

[54] AIR WASHER AND HEAT EXCHANGER

[75] Inventor: Henry T. Childs, Chattanooga, Tenn.

[73] Assignee: Temperature Adjusters, Inc., Chattanooga, Tenn.

[21] Appl. No.: 836,696

[22] Filed: Mar. 6, 1986

Related U.S. Application Data

[63] Continuation-in-part of Ser. No. 601,655, Apr. 18, 1984, abandoned.

[51] Int. Cl.[4] ..... B01D 53/14

[52] U.S. Cl. ..... 55/89; 55/94; 55/164; 55/228; 55/229; 55/230; 55/242

[58] Field of Search ..... 55/89, 93, 94, 164, 55/242, 227–230

[56] References Cited

U.S. PATENT DOCUMENTS

| | | | |
|---|---|---|---|
| 3,282,047 | 11/1966 | Wertheimer | 55/229 X |
| 3,353,335 | 11/1967 | Caballero | 55/94 |
| 3,479,799 | 11/1969 | Aoki | 55/230 |
| 3,704,570 | 12/1972 | Gardenier | 55/89 X |
| 3,890,103 | 6/1975 | Konishi | 55/230 X |
| 4,290,348 | 9/1981 | Morgan et al. | 55/227 X |
| 4,294,781 | 10/1981 | Holmquist | 55/230 X |

*Primary Examiner*—Charles Hart

[57] ABSTRACT

This invention relates to a method and apparatus for the extraction of pollutant materials from the exhaust gases of a flue, chimney or smokestack and for the extraction and collection of any heat from such exhaust. The apparatus can be adjusted vertically and horizontally in length to obtain a high efficiency in the extraction of pollutant materials and heat from said exhaust gases. The design is for the pollutant material to be washed from the exhaust gases with said washing system to be mechanical and free from the problems of a pressurized water system. The design also is for the heat to be washed from the exhaust gases, which is usually lost to the outdoor air, with said heat transferred into other areas, or into a water storage tank.

4 Claims, 7 Drawing Figures

AIR WASHER AND HEAT EXCHANGER

RELATED U.S. APPLICATION DATA

Continuation in part of Ser. No. 06/601,655 filed Apr. 18, 1984.

BACKGROUND OF THE INVENTION

There has been a gtrowing need for the reduction of pollution from our air, as such could cause severe damage to our health, to our wild life and to our vegetation. Acid rain is even believed to be caused by such pollution which endangers our fish in lakes and streams. One way to help reduce this pollution problem is to have a simple inexpensive trouble free way to clean the exhaust gases from fuel burn exhaust pipes, flues, chimneys and smokestacks.

In this invention the design relates to an inexpensive near trouble free method and apparatus for the extraction of pollutant materials and heat from the exhaust gases of fuel burns.

SUMMARY OF THE INVENTION

The purpose of this invention is to provide an inexpensive trouble free way to extract pollutant materials and existing heat from the exhaust gases of fuel burns from flues, chimneys and smokestacks and to transfer said heat elsewhere.

The design is flexible and can be adjusted to fit most any chimney or exhaust even to the exhaust of a motor or diesel engine. The apparatus is mechanical, thus eliminating most of the problems of a pressurized system. The heat that is collected is heat that is usually lost to the outdoors, thus a savings is realized.

Various other features of the method and apparatus of the present invention will become obvious to those skilled in the act upon reading the disclosure set forth hereinafter.

BRIEF DESCRIPTION OF DRAWINGS

Referring now to the drawings which show the apparatus and its functions of receiving exhaust gases, washing pollutant materials from said gases and delivering same to the outdoors, and collecting the impurities and any existing heat in its water reservoir.

DETAILED DESCRIPTION

Figure 1:
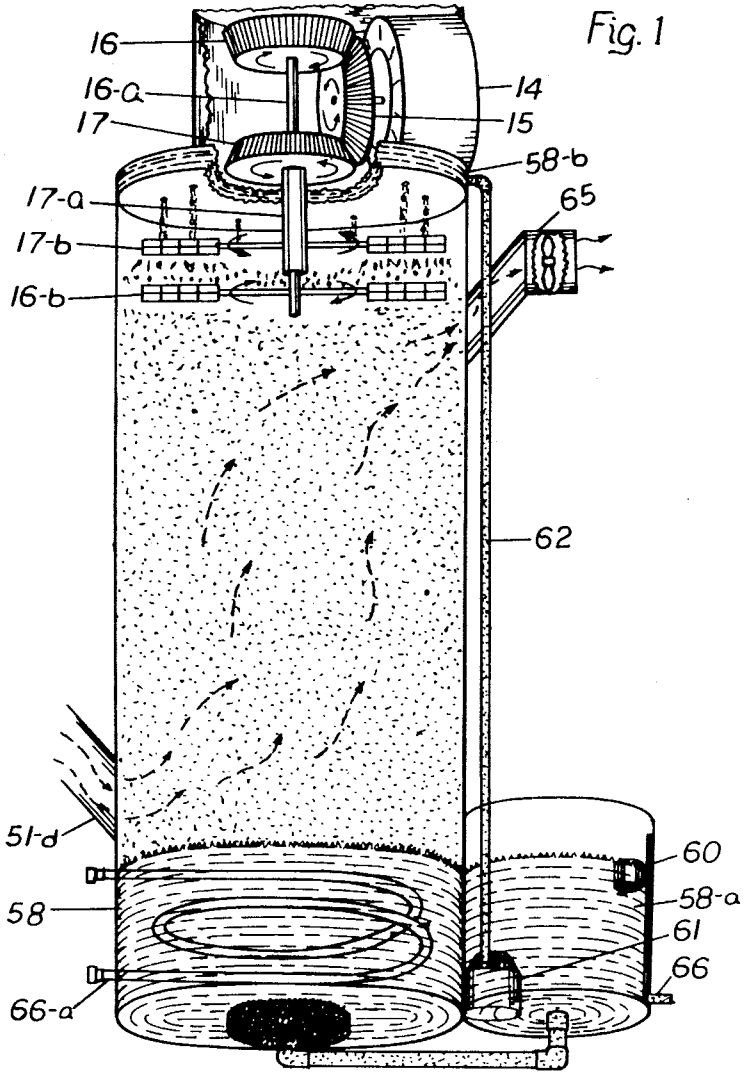
FIG. 1, is a cut-a-way view of the apparatus showing a vertical chamber and the various components consisting of a reservoir of water at its base, water filters, water pump, water float valve and water heat pipe coils, exhaust gas intake and discharge pipes, and the mechanically rotating dashers that move in reverse rotations, which create the mist and spray of rain that washes the air.

Referring to FIG. 1, there is illustrated a cut-a-way layout of the apparatus connected to the exhaust of a flue or chimney through intake pipe 51-*d*, with said exhaust gases passing through its chamber to the outdoors through discharge pipe 65. A reservoir 58, containing water, is located at its base, which contains a filtering system that cleans the water of pollutant material as it passes from the reservoir into the adjacent reservoir 58-*a*. Reservoir 58-*a* contains a float valve 60 that maintains a constant level of water in both reservoirs with said water being supplied from outside source through water pipe 66. A water pump 61 is also located in or near reservoir 58-*a* and pumps water from said reservoir 58-*a* up through pipe 62 into the small reservoir 58-*b* that is located at the top of the apparatus. The small reservoir 58-*b* contains several small adjustable holes in its bottom and allows small streams of water to fall through said holes. At the top of the apparatus, motor 14 is positioned at the top of the reservoir 58-*b* and drives bevel gear 15, which drives bevel gear 16, which turns shaft 16-*a*, which turns dashers 16-*b*, said gear 16, shaft 16-*a*, and dashers 16-*b* all rotating in the same direction. Bevel gear 15 also drives bevel gear 17, which turns in the opposite direction of bevel gear 16, said bevel gear 17 turns shaft 17-*a*, which turns dashers 17-*b*, all rotating in the opposite direction of gear 16, shaft 16-*a* and dashers 16-*b*, as the shaft 16-*a* protrudes down through shaft 17-*a* and is held in place by wheel bearings.

As water falls from the holes in the bottom of reservoir 58-*b*, it falls on rotating or whirling dashers 17-*b*, which brakes up the water into small droplets, which then falls on the reverse rotating or whirling dashers 16-*b*, thus a fine mist and spray of water is formed, which attaches to pollutant particles rising through the apparatus chamber and causes said particles to fall into the reservoir 58 below, thus cleaning the exhaust gases as they pass through the apparatus chamber to the outdoors. An induced draft fan can be located in exhaust discharge pipe 65 to be used when needed.

As the exhaust gases pass up through the mist and spray of water in the apparatus chamber, any heat that said exhaust gases contain is absorbed by the water spray and is deposited in the reservoir 58 below. Water heat pipes 66-*a*, coiled through said reservoir 58, can absorb this heat and deliver it into other desired areas or into water storage tanks, thus saving heat that is ordinarily lost to the outdoors.

Figure 2:
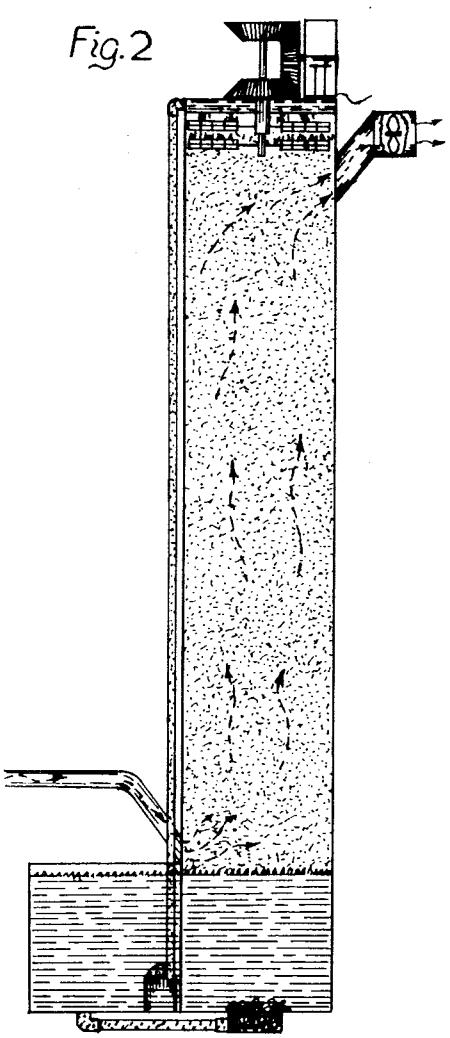
FIG. 2, is a cut-a-way view of the apparatus and its components showing its size adjusted for attaching same to a small exhaust such as a diesel engine.

FIG. 2, shows a cut-a-way view of the apparatus with the size reduced to allow its use on a small exhaust such as a diesel engine. Its functions are as described in FIG. 1 above, however the water heat pipe coils in its reservoir could be optional.

Figure 3:
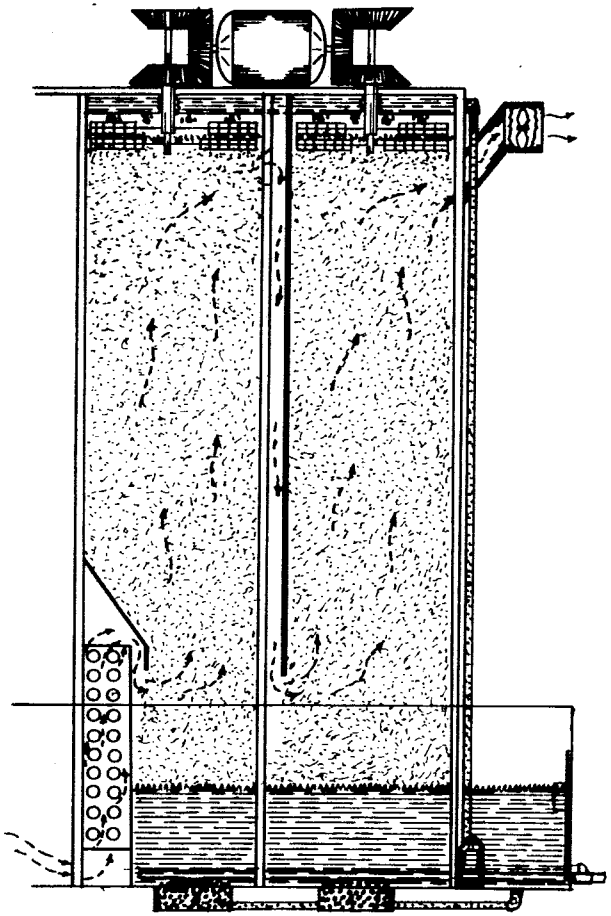
FIG. 3, is a cut-a-way view showing how the apparatus can be adjusted to extend it horizontally by attaching two or more apparatuses together.

FIG. 3 shows a cut-a-way view of the two apparatus chambers each having all of its components and installed together to allow the fuel burn exhaust gases to pass from the discharge pipe of one into the chamber base of the other, thus extending the washing of said exhaust gases. This is an example of how the apparatus can be adjusted horizontally to any necessary length to efficiently clean said exhaust gases of its pollutant materials.

Figure 4:
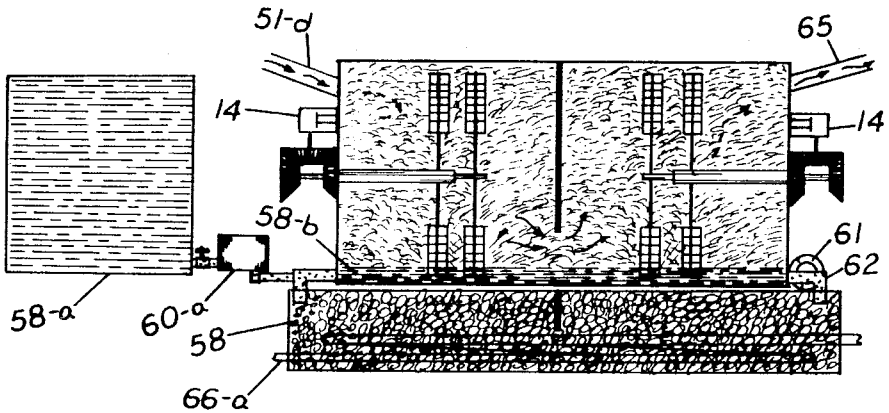
FIG. 4, is a cut-a-way view showing a horizontal chamber with two sets of mechanically rotating dashers that move in reverse rotations, which upon striking the water in its base, creates the mist and spray of rain that washes the exhaust air, as it passes through the chamber.

FIG. 4, is a cut-a-way view of the apparatus chamber positioned horizontally with a set of mechanically rotating dashers, that move in reverse rotation, located at each end of the chamber, and a partition positioned vertically at the inside top center of said chamber and extending from the inside top down most of the distance to the inside bottom, thereby causing the exhaust gases to circulate down through one side of the chamber, pass under the partition and continue up through the other side and out through the discharge pipe 65 to the outdoors. Water reservoir 58, containing filters, contain water heat pipe coils 66-*a*, and has its water circulated through the base of the chamber by water pump 61. Said water level in the chamber is adjusted and maintained by the water from storage reservoir 58-*a*, that passes through the water level valve 60-*a*. As the two motors 14, each rotate its set of dashers in opposite directions, their rotation causes the dashers to strike the water in the bottom of the chamber causing great turbulence and a creation of water mist and spray that fills the chamber, thus washing the exhaust gases that enter the chamber at intake pipe 51-*d*, circulate down through the water mist and spray and pass under the partition dividing the chamber, then up through the water mist and spray created by the second set of reverse rotating dashers, and pass outdoors through discharge pipe 65, having pollutant materials and heat washed from it into the water reservoir below.

Figure 5:
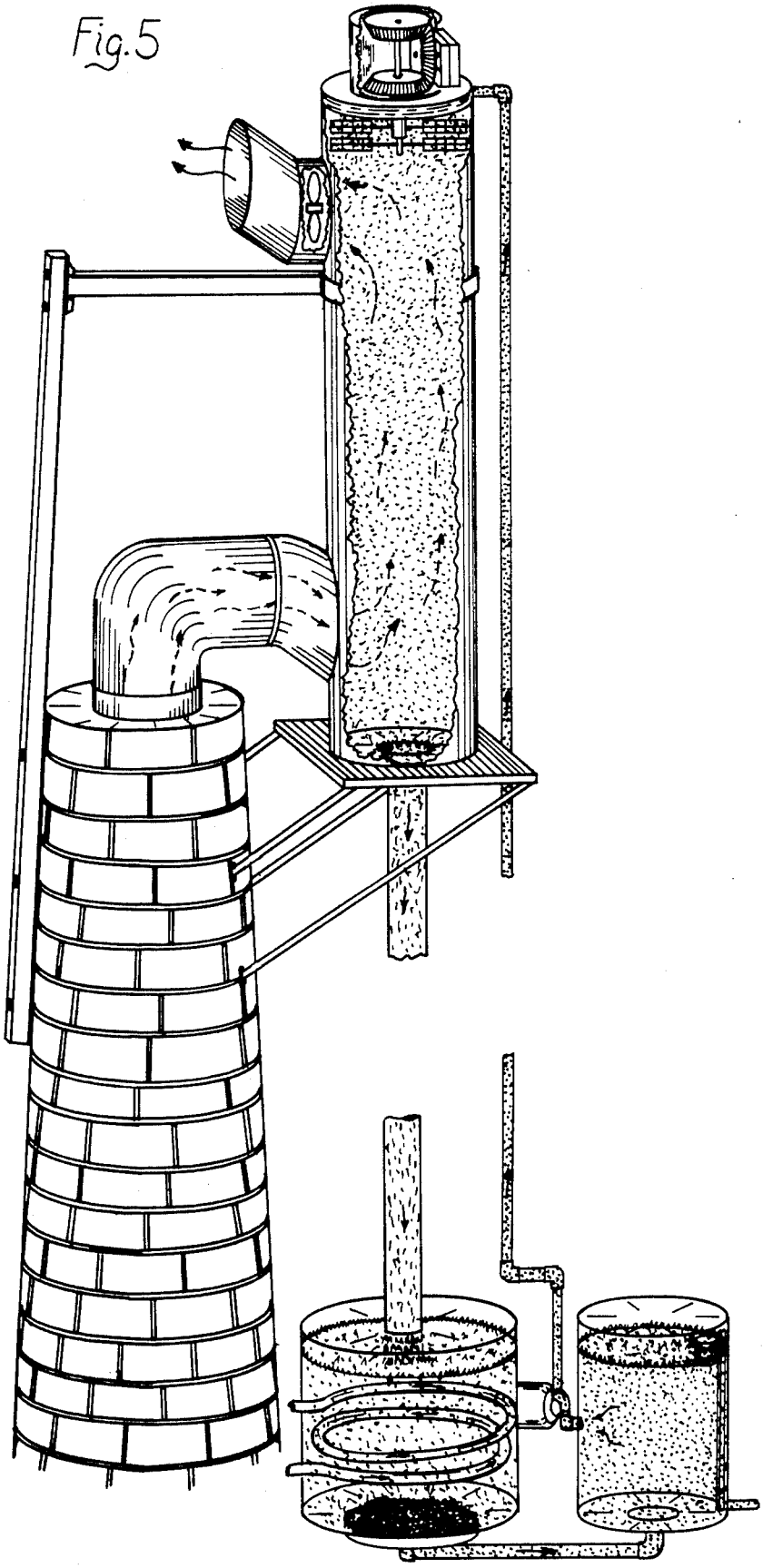
FIG. 5, is a cut-a-way view of the apparatus and its chamber attached to the top of a chimney or smokestack and connected to its reservoir of water located elsewhere below said apparatus, and showing the mechanically rotating dashers that move in reverse rotations, and the small reservoir at its tp.

FIG. 5, is a cut-a-way view of the apparatus attached to the top exhaust of a chimney or smokestack so that the exhaust gases will pass through said apparatus, thus having pollutant materials and heat washed from it into the water reservoir below.

Figure 6:
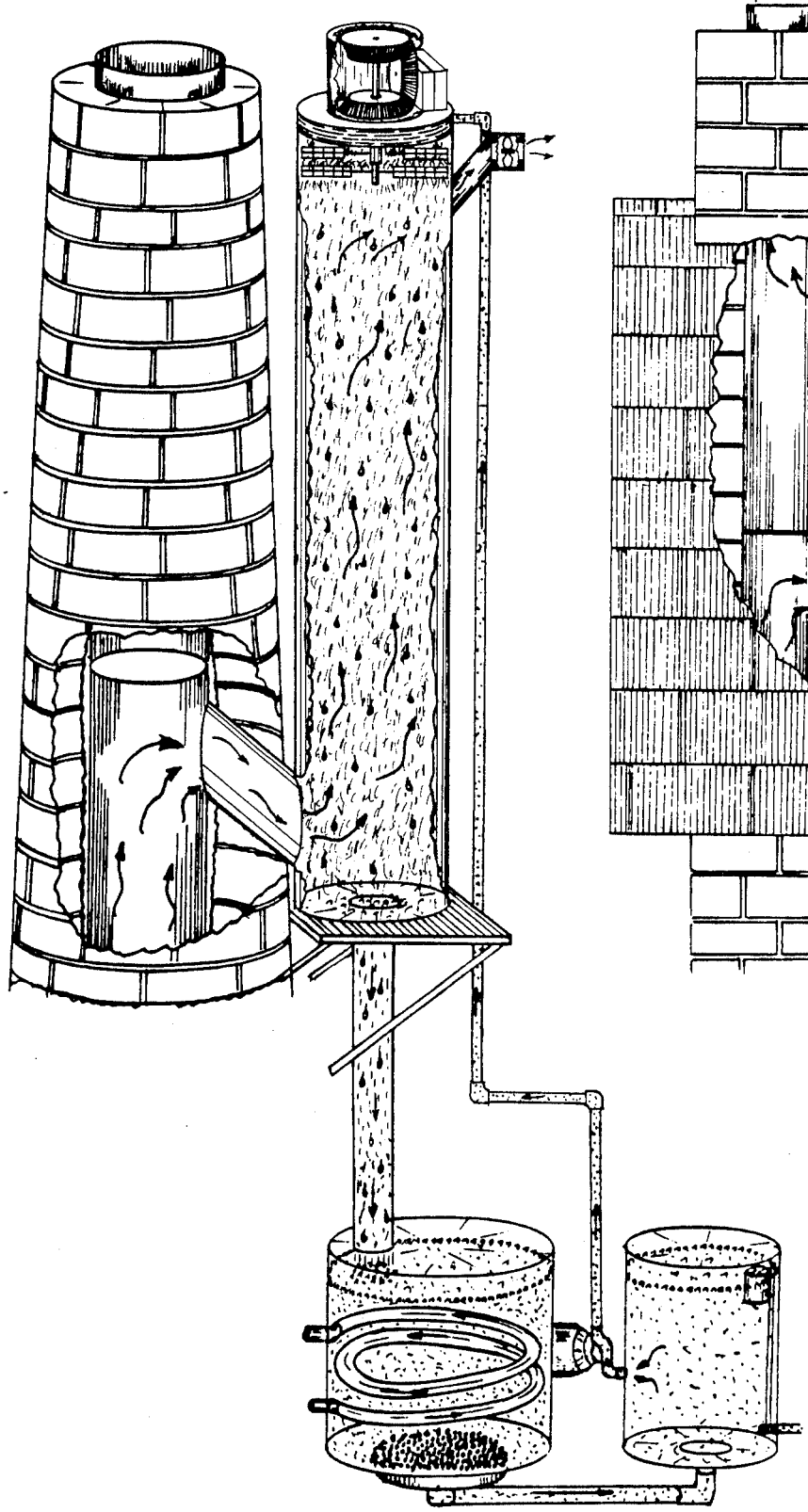
FIG. 6, is a cut-a-way view of the apparatus and its chamber attached to the side of a chimney or smokestack.

FIG. 6, is a cut-a-way view of the apparatus attached to the side of a chimney or smokestack, with its exhaust gases passing through the apparatus chamber, thus having pollutant materials and heat washed from it into the water reservoir below.

Figure 7:
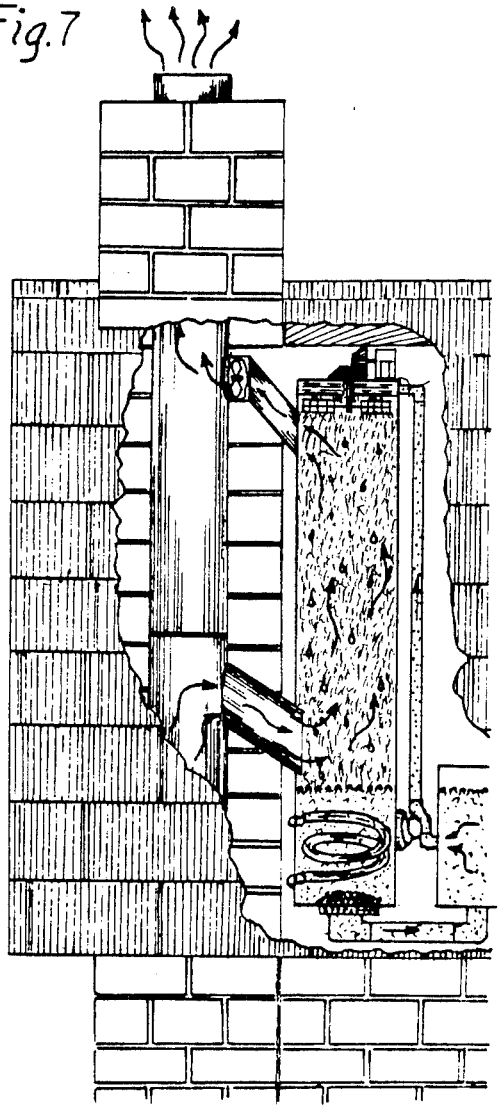
FIG. 7, is a cut-a-way view of the apparatus and its chamber located in the attic of a building and attached to the side of a chimney or flue.

FIG. 7 shows a cut-a-way view of the apparatus located in the attic of a building and attached to the side of a flue or chimney with the exhaust gases passing through the apparatus chamber, thus having pollutant materials and heat washed from it into the water reservoir below.

It is to be understood that the foregoing drawings and description of the invention is to be taken as a preferred embodiment and that various other modifications will occur to those skilled in the art upon reading the disclosure, however all changes and modifications that come within the spirit of the invention are desired to be protected.

I claim:

1. A method of changing water into mist and spray and washing pollutant materials and heat from smokey gases, comprising the steps of a. having a chamber, b. positioning at least one motor near the chamber, having its shaft attached to a gear in a gear train, c. having two gears, in said gear train, each with a single shaft, positioned to allow the shaft of one to extend through the shaft of the other, with each shaft supporting at least one dasher, said gear train providing the means of said motor rotating the shafts and dashers in opposite directions in a whirling motion inside the chamber, d. locating a reservoir of water near the chamber base, e. positioning a water pump, protected by filters, to have means of delivering a continuous volume of water from said reservoir into the paths of the whirling dashers, thus creating a mist and spray, f. connecting a gas intake pipe to the chamber, thus providing means for the polluted gases to pass into the chamber, and its mist and spray of water, and having means of delivering said pollutant materials and heat, washed by the mist and spray from the smokey gases, into the reservoir of water below, g. connecting a discharge pipe to the chamber, providing means for the gases to pass out of the chamber, h. installing water heat pipe coils through the reservoir of water, having means of delivering heat elsewhere, i. having means of supplying an outside source of water to the reservoir, j. locating a water level valve positioned to maintain a constant volume of water in the reservoir, k. having a drain connected to the reservoir, supplying means for changing reservoir water, l. locating an induced draft fan positioned in or near the discharge pipe for needed draft through the chamber.

2. An apparatus for changing water into mist and spray and washing pollutant materials and heat from smokey gases, comprising a. a chamber, b. at least one motor located near the chamber, having its shaft attached to a gear in a gear train, c. two gears, in said gear train, each having a single shaft, positioned to allow the shaft of one to extend through the shaft of the other, with each shaft supporting at least one dasher, said gear train providing the means of said motor rotating the shafts and dashers in opposite directions in a whirling motion inside the chamber.

d. a reservoir of water located near the chamber base, e. a water pump, protected by filters, having means of delivering a continuous volume of water from said reservoir of water into the paths of the whirling dashers, thus creating a mist and spray, f. a gas intake pipe connected to the chamber, thus providing means for the polluted gases to pass into the chamber, and its mist and spray of water, and having means of delivering said pollutant materials and heat, washed by the mist and spray from the smokey gases, into the reservoir of water below, g. a discharge pipe connected to the chamber, providing means for the gases to pass out of the chamber, h. water heat pipe coils located through the reservoir of water, having means of delivering heat elsewhere, i. means of supplying an outside source of water to the reservoir, j. a water level valve positioned to maintain a constant volume of water in the reservoir, k. a drain connected to the reservoir, supplying means for changing reservoir water, l. an induced draft fan positioned in or near the discharge pipe for needed draft through the chamber.

3. A method of changing water into mist and spray and washing pollutant materials and heat from smokey gases, comprising the steps of a. having a chamber, b. positioning at least one motor near the chamber, having its shaft attached to a gear in a gear train, c. having two gears, in said gear train, each with a single shaft, positioned to allow the shaft of one to extend through the shaft of the other, with each shaft supporting at least one dasher, said gear train providing the means of said motor rotating the shafts and dashers in opposite directions in a whirling motion inside the chamber, d. locating a reservoir of water near the base, e. positioning a water pump, protected by filters, to have means of delivering a continuous volume of water from said reservoir into the paths of the whirling dashers, thus creating a mist and spray, f. connecting a gas intake pipe to the chamber, thus providing means for the polluted gases to pass into the chamber, and its mist and spray of water, and having means of delivering said pollutant materials and heat, washed by the mist and spray from the smokey gases, into the reservoir of water below, g. connecting a discharge pipe to the chamber, providing means for the gases to pass out of the chamber, h. installing water heat pipe coils through the reservoir of water with means of delivering heat elsewhere, i. connecting the reservoir to a source of outside water supply, j. having a water level valve positioned to maintain a constant volume of water in the reservoir, k. having a drain pipe connected to the reservoir for supplying means of changing reservoir water, l. having an induced draft fan in or near the discharge pipe for needed draft through the chamber, m. having at least one additional chamber, n. having the gas intake pipe of each additional chamber connected to the gas discharge pipe of its preceding adjacent chamber, thus providing means for said gases to pass from the original chamber into and through each additional chamber, o. having each additional chamber contain the components of the original chamber, thus supplying means of extending the washing of the smokey gases through at least two chambers of mist and spray of water.

4. An apparatus for changing water into mist and spray and washing pollutant materials and heat from smokey gases, comprising a. a chamber, b. at least one motor near the chamber, having its shaft attached to a gear in a gear train, c. two gears, of said gear train, each with a single shaft, positioned to allow the shaft of one to extend through the shaft of the other, with each shaft supporting at least one dasher, said gear train providing the means of said motor rotating the shafts and dashers in opposite directions in a whirling motion inside the chamber, d. a reservoir of water near the base, e. a water pump, protected by filters, to have means of delivering a continuous volume of water from said reservoir into the paths of the whirling dashers, thus creating a mist and spray, f. a gas intake pipe connected to the chamber, thus providing means for the polluted gases to pass into the chamber, and its mist and spray of water, and having means of delivering said pollutant materials and heat, washed by the mist and spray from the smokey gases, into the reservoir of water below, g. a discharge pipe connected to the chamber, providing means for the gases to pass out of the chamber, h. water heat pipe coils located through the reservoir of water, having means of delivering heat elsewhere, i. said reservoir being connected to a source of outside water supply, j. a water level valve positioned to maintain a constant volume of water in the reservoir, k. a drain pipe connected to the reservoir supplying means of changing reservoir water, l. an induced draft fan in or near the discharge pipe for needed draft through the chamber, m. at least one additional chamber, n. the gas intake pipe of each additional chamber connected to the gas discharge pipe of its preceding adjacent chamber, thus providing means for said gases to pass from the original chamber into and through each additional chamber, o. each additional chamber containing the components of the original chamber, thus supplying means of extending the washing of the smokey gases through at least two chambers of mist and spray of water.

* * * * *